US009423723B2

(12) United States Patent
Takaya et al.

(10) Patent No.: US 9,423,723 B2
(45) Date of Patent: Aug. 23, 2016

(54) IMAGE FORMING APPARATUS AND IMAGE FORMING DEVICE WITH TONER LAYER FORMING UNIT

(71) Applicant: Konica Minolta, Inc., Chiyoda-ku, Tokyo (JP)

(72) Inventors: Shunichi Takaya, Hino (JP); Hiroyuki Saito, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/718,482

(22) Filed: May 21, 2015

(65) Prior Publication Data

US 2015/0338782 A1 Nov. 26, 2015

(30) Foreign Application Priority Data

May 26, 2014 (JP) ..... 2014-108558

(51) Int. Cl.
*G03G 15/00* (2006.01)
*G03G 21/00* (2006.01)
*G03G 15/16* (2006.01)

(52) U.S. Cl.
CPC ..... *G03G 15/16* (2013.01); *G03G 15/161* (2013.01); *G03G 2215/0478* (2013.01)

(58) Field of Classification Search
CPC .. G03G 15/16; G03G 15/161; G03G 21/0041
USPC ..... 399/66, 302, 308
See application file for complete search history.

(56) References Cited

U.S. PATENT DOCUMENTS

2006/0216047 A1 9/2006 Yamamoto et al.
2007/0025780 A1 2/2007 Kurosu et al.
2007/0036569 A1* 2/2007 Taguchi ..... G03G 15/161 399/49
2008/0037038 A1 2/2008 Arai
2014/0076488 A1* 3/2014 Kanamura ..... B32B 37/025 156/247

FOREIGN PATENT DOCUMENTS

EP 1813559 A2 8/2007
JP 62047685 A 3/1987
JP 2003248360 A 9/2003
JP 2004226824 A 8/2004

OTHER PUBLICATIONS

Machine translation of JP 2003-248360 (with publication date of Sep. 5, 2003) printed on Dec. 1, 2015.*
Extended European Search Report corresponding to Application No. 15168511.2-1560; Date of Mailing: Oct. 2, 2015.

* cited by examiner

*Primary Examiner* — Sophia S Chen
(74) *Attorney, Agent, or Firm* — Cantor Colbrun LLP

(57) ABSTRACT

An image forming apparatus of the present invention includes an image carrying member capable of carrying an image, a paper conveying unit, a toner layer forming unit, and a transfer unit. The paper conveying unit conveys a paper to the image carrying member. The toner layer forming unit forms a toner layer having a predetermined width at an outer side of the paper from a position corresponding to an end portion of the paper on a surface of the image carrying member. The transfer unit conveys the paper in press-contact with the image carrying member with the formed image and toner layer and transfers the image to the paper.

16 Claims, 7 Drawing Sheets

IMAGE FORMING APPARATUS AND IMAGE FORMING DEVICE WITH TONER LAYER FORMING UNIT

CROSS-REFERENCE TO RELATED APPLICATION

The present invention claims priority under 35 U.S.C. §119 to Japanese Application No. 2014-108558 filed on May 26, 2014, the entire content of which is incorporated herein by reference.

BACKGROUND

1. Technical Field

The present invention relates to an image forming apparatus and an image forming method.

2. Description of Related Arts

There has been developed an image forming apparatus capable of coping with various types of papers such as a long paper (for example, a roll-to-roll paper) wound in a roll shape or a so-called label paper attachable as a seal as well as a generally used paper having an A4 size, a B5 size, etc.

When an image is printed in an image forming apparatus by using such a special paper, material of a paper may project from the end portion of the paper. For example, when an image is printed on a label paper including an adhesive such as a paste, the adhesive may project from the end portion of the paper. Particularly, in a secondary transfer unit of an image forming apparatus employing an intermediate transfer scheme, since a label paper is brought into press-contact with an intermediate transfer belt, it is probable that an adhesive projects from the end portion of the paper, and is transferred to and is attached to the intermediate transfer belt. Furthermore, when the label paper is long, since a part including the adhesive is long, it is more probable that the adhesive is transferred and attached to the intermediate transfer belt.

Furthermore, for example, when a long paper such as a roll-to-roll paper has been cut, cutting waste may be attached to the end portion of the paper. It is probable that the cutting waste attached to the end portion of the paper is peeled off and is attached to an intermediate transfer belt.

When the adhesive, the cutting waste, etc., are transferred and attached to the intermediate transfer belt, for example, a primary transfer unit, a secondary transfer unit, and a cleaning device associated with these units may be abnormally worn, or failure may occur when a toner image is transferred.

In this regard, a technology, which has a purpose of preventing the attachment of an adhesive to a photoreceptor with respect to a label paper including the adhesive in an image forming apparatus employing a direct transfer scheme, is disclosed in Japanese Unexamined Publication No. 2004-226824. In the technology of Japanese Unexamined Publication No. 2004-226824, after an external additive having a polarity opposite to toner is supplied, the separate external additive not attached to a toner surface is allowed to be attached to a non-image area of a photoreceptor so as to be developed, and is allowed to be interposed between the paper and the photoreceptor, so that the adhesive is prevented from being attached to the photoreceptor.

However, since the amount of particles of the separate external additive not attached to the toner surface is small, the amount of particles of the external additive attached to the non-image area of the photoreceptor is also small. As a consequence, there is a problem that the effect of preventing the adhesive from being attached to the photoreceptor is small. The present invention is intended to solve the aforementioned problems, and one of the objectives of the present invention is to provide an image forming apparatus and an image forming method, by which it is possible to more reliably prevent a foreign matter projecting from the end portion of a paper from being attached to a member of a transfer unit.

SUMMARY

In order to achieve at least one of the aforementioned objectives, an image forming apparatus, reflecting one aspect of the present invention, comprises: an image carrying member capable of carrying an image; a paper conveying unit for conveying a paper to said image carrying member; a toner layer forming unit for forming a toner layer having a predetermined width at an outer side of said paper from a position corresponding to an end portion of said paper on a surface of said image carrying member; and a transfer unit for conveying said paper in press-contact with said image carrying member with said formed image and toner layer and transferring said image to said paper.

Preferably, said toner layer forming unit forms a toner layer from an inner side to an outer side across a position corresponding to said end portion of said paper on said surface of said image carrying member.

Preferably, said toner layer forming unit forms a single layer of toner layer or a plurality of stacked toner layers.

Preferably, said toner layer forming unit forms a larger number of stacked toner as it goes toward said position corresponding to said end portion of said paper in said surface of said image carrying member.

Preferably, said toner layer forming unit forms said toner layer by using toner of a color with a small consumption amount.

Preferably, said image forming apparatus further comprises a paper end detection unit for detecting said end portion of said paper, wherein said toner layer forming unit decides a position, in which said toner layer is to be formed, in response to a detection result of said paper end detection unit.

Preferably, said image carrying member includes an intermediate transfer belt.

Preferably, said image carrying member includes a photosensitive drum.

Preferably, said paper includes an adhesive layer.

The objectives, features, and characteristics of this invention other than those set forth above will become apparent from the description given herein below with reference to preferred embodiments illustrated in the accompanying drawings.

DETAILED DESCRIPTION

Figure 1:
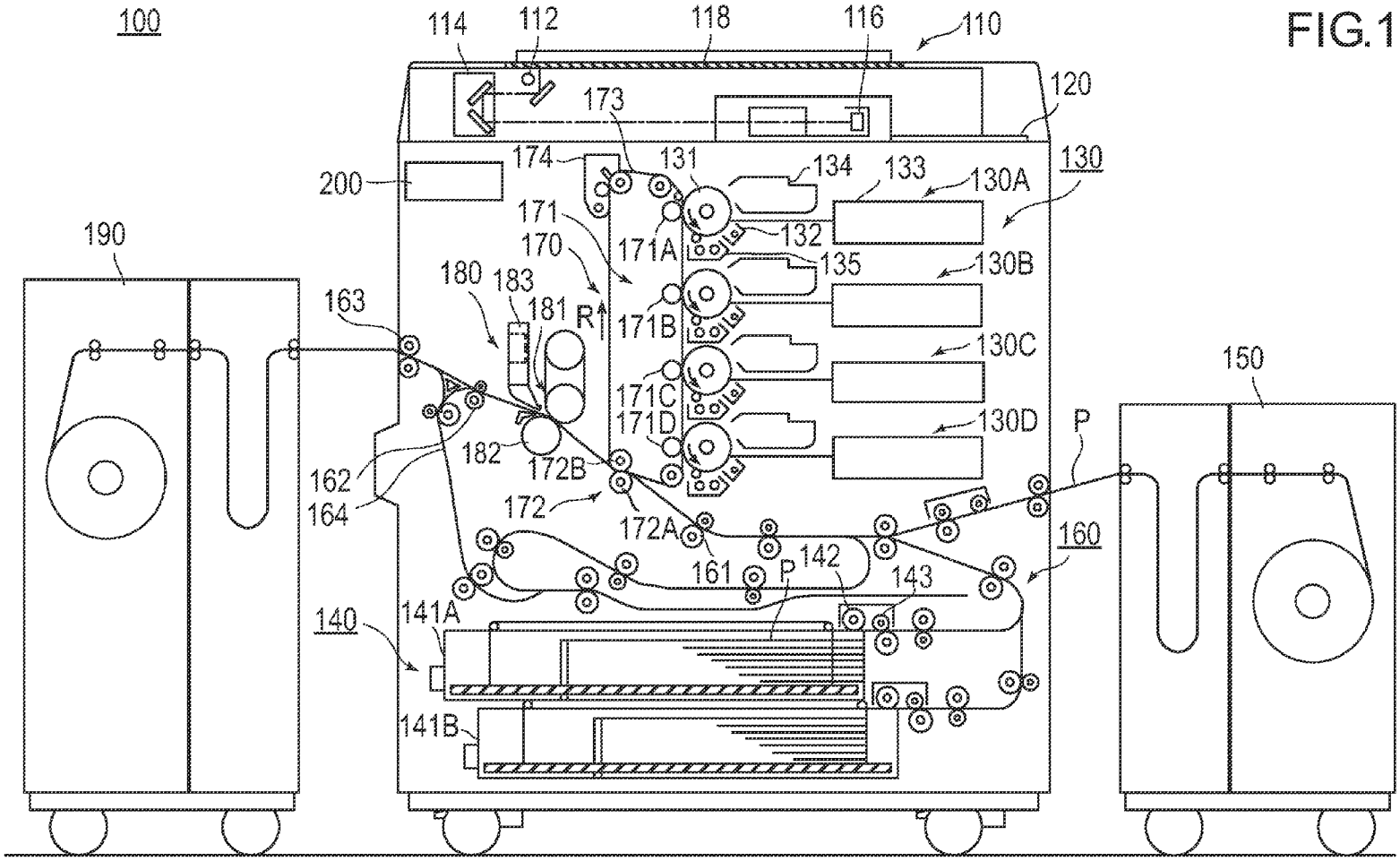
FIG. 1 is a schematic sectional view showing the entire structure of an image forming apparatus in a first embodiment of the present invention.

The embodiments of this invention will be described below with reference to the accompanying drawings. In addition, in a description of the drawings, the same reference numerals are used to designate the same elements and a redundant description will be omitted. Furthermore, the dimension ratio of each drawing is exaggerated for the sake of description, and may differ from an actual ratio.

(First Embodiment)

FIG. 1 is a schematic sectional view showing the entire structure of an image forming apparatus in a first embodiment of the present invention. An image forming apparatus 100 includes an image reading unit 110, an operation display unit 120, an image forming unit 130, a first paper feeding unit 140, a second paper feeding unit 150, a paper conveying unit 160, a transfer unit 170, a fixing unit 180, a paper discharge unit 190, and a control unit 200.

The image forming apparatus 100 has a function of preventing a foreign matter (hereinafter, referred to as a "foreign matter projecting from the end portion of a paper") such as an adhesive projecting from the end portion of the paper or cutting waste attached to the end portion of the paper from being attached to a member of the transfer unit 170. In the present embodiment, the case in which an adhesive serving as a foreign matter projects from the end portion of the paper will be described as one example.

<Image Reading Unit>

The image reading unit 110 generates image data of a document. The image reading unit 110 includes a light source 112, an optical system 114, an imaging element 116, and a reading surface 118. The light source 112 irradiates light onto a document placed on the reading surface 118, and an image of reflected light is formed on the imaging element 116, which has moved to a reading position, via the optical system 114. The imaging element 116, for example, includes a line image sensor, and generates an electrical signal in response to reflected light intensity. The generated electrical signal is subjected to A/D conversion, shading correction, filter processing, image compression processing, etc., and then is input to the image forming unit 130.

<Operation Display Unit>

The operation display unit 120 has a function of receiving input by a user and a function of outputting data and various types of information to a screen. The operation display unit 120 includes an input device such as a touch panel, a keyboard, and a mouse and an output device such as a display. The operation display unit 120, for example, receives a print instruction, various types of setting, etc., from a user through the touch panel or the keyboard, and displays a progress status of a print job, an occurrence status of an error, a current status of various types of setting, etc., on the screen of the display.

In the present embodiment, the image forming apparatus 100 has a function of preventing an adhesive projecting from a paper from being attached to the member of the transfer unit 170, and can set whether to validate or invalidate the function via the operation display unit 120.

<Image Forming Unit>

The image forming unit 130 forms a toner image on a photosensitive drum serving as an image carrying member by using an electrophotographic process. Furthermore, as will be described later, the image forming unit 130 of the present embodiment forms a toner layer on the surface of the photosensitive drum according to an instruction of the control unit 200. The image forming unit 130 serves as a toner layer forming unit.

The image forming unit 130 includes an image forming unit 130A for forming an image of a yellow (Y) color, an image forming unit 130B for forming an image of a magenta (M) color, an image forming unit 130C for forming an image of a cyan (C) color, and an image forming unit 130D for forming an image of a black (K) color.

Each of the image forming units 130A to 130D includes a photosensitive drum 131, a charging unit 132, an optical writing unit 133, a developing device 134, and a photoreceptor cleaning unit 135.

The photosensitive drum 131 is an image carrying member having a photosensitive layer made of resin such as polycarbonate including an OPC (Organic Photo Conductor), and is configured to rotate at a predetermined speed in an arrow direction shown in FIG. 1.

The charging unit 132 includes a corona discharge electrode arranged in the vicinity of the photosensitive drum 131, and charges the surface of the photosensitive drum 131 by a generated ion.

The optical writing unit 133 forms a charge pattern corresponding to image data on the photosensitive drum 131. The optical writing unit 133 includes a scanning optical device, and exposes the charged photosensitive drum 131 based on the image data, thereby reducing the potential of an exposed part and forming the charge pattern (an electrostatic latent image) corresponding to the image data. In the present specification, a position, in which the optical writing unit 133 exposes the photosensitive drum 131 and writes the image data, will be referred to as an "image writing position".

The developing device 134, for example, is a 2-ingredient reverse rotation developing device, develops the electrostatic latent image formed on the photosensitive drum 131, and visualizes the electrostatic later image by toner. On the photosensitive drum 131 of each of the image forming units 130A, 130B, 130C, and 130D, a monochromatic toner image corresponding to a yellow color, a magenta color, a cyan color, and a black color is formed. In addition, a grain size of the toner used in the present embodiment, for example, is about 6 μm.

The photoreceptor cleaning unit 135 cleans the surface of the photosensitive drum 131. In more detail, after the toner image is transferred to an intermediate transfer belt 173 to be described later, the photoreceptor cleaning unit 135 scrapes (removes) residual material such as toner and an external additive remaining on the surface of the photosensitive drum 131, thereby maintaining a clean surface state.

<First Paper Feeding Unit>

The first paper feeding unit 140 and the second paper feeding unit 150 hold papers P on which an image is to be printed, and supplies the papers P to the transfer unit 170.

The first paper feeding unit 140 includes paper trays 141A and 141B, a delivery roller 142, and a separation roller 143. The paper trays 141A and 141B accommodate generally used papers having an A4 size, an A3 size, a B5 size, etc. The delivery roller 142 and the separation roller 143 send the papers P from the paper trays 141A and 141B to a conveyance path one by one.

<Second Paper Feeding Unit>

The second paper feeding unit 150 supplies a long paper P. In the present embodiment, the paper P, for example, may be a roll paper for label print (hereinafter, simply referred to as a "label paper"). The paper P is wound around a support axis so as to be rotatably held, and is conveyed at a constant speed by a plurality of paper feeding rollers. In addition, in the present embodiment, the paper P is held in a roll shape. However, the paper P is not always needed to be held in the roll shape, and may be folded and held. Furthermore, FIG. 1 shows only one roll-shaped paper P; however, a plurality of roll-shaped papers P may be held.

<Paper Conveying Unit>

The paper conveying unit 160 conveys the paper P. The paper conveying unit 160 has a plurality of conveying rollers including a resist roller 161, a fixing conveyance roller 162 and a paper discharge roller 163, and a paper reversing unit 164. The paper P is conveyed to the transfer unit 170, the fixing unit 180, and the paper discharge unit 190 by the plurality of conveying rollers.

In more detail, the resist roller 161 conveys the paper P, which has been fed from the first paper feeding unit 140 or the second paper feeding unit 150, to the transfer unit 170. Furthermore, the fixing conveyance roller 162 conveys the paper P, which has passed through the transfer unit 170 and the fixing unit 180, toward the paper discharge roller 163. Moreover, the paper discharge roller 163 conveys the paper P, on which the toner image has been fixed by the fixing unit 180, to the paper discharge unit 190.

The paper reversing unit 164 is used in order to reverse and discharge the front and the back of the paper P, or to form an image on both surfaces of the paper P. The paper reversing unit 164 introduces the paper P, which has been supplied from the first paper feeding unit 140 and passed through the fixing conveyance roller 162, to a conveyance path between the paper trays 141A and 141B and the paper discharge roller 163, but not to a conveyance path directed to the paper discharge roller 163.

<Transfer Unit>

The transfer unit 170 transfers the toner image to the paper P. The transfer unit 170 includes a primary transfer unit 171, a secondary transfer unit 172, the intermediate transfer belt 173, and an intermediate transfer cleaning unit 174.

The primary transfer unit 171 transfers the toner image formed on the photosensitive drum 131 to the intermediate transfer belt 173. The primary transfer unit 171 includes primary transfer modules 171A, 171B, 171C, and 171D respectively corresponding to a yellow color, a magenta color, a cyan color, and a black color. The primary transfer modules 171A to 171D are arranged at predetermined intervals along the intermediate transfer belt 173 such that the primary transfer module 171A is arranged at the uppermost upstream side with respect to a rotation direction of the intermediate transfer belt 173 and the primary transfer module 171D is arranged at the lowermost downstream side.

In the present embodiment, as will be described later, the primary transfer unit 171 also plays a role of transferring a toner layer formed on the photosensitive drum 131 to the intermediate transfer belt 173. The primary transfer unit 171 serves as a toner layer forming unit.

The secondary transfer unit 172 transfers the toner image transferred to the intermediate transfer belt 173 to the paper P. In the present embodiment, the secondary transfer unit 172 includes a secondary transfer roller 172A and a secondary transfer opposing roller 172B. The secondary transfer unit 172 conveys the paper P in press-contact with the intermediate transfer belt 173 with the formed toner image and toner layer by the secondary transfer roller 172A and the secondary transfer opposing roller 172B, thereby transferring the toner image to the paper P. In addition, a distance between the secondary transfer unit 172 and the intermediate transfer belt 173 is positioned such that the paper P can pass through therebetween.

As described above, the toner images of each color formed in the image forming units 130A to 130D are sequentially transferred onto the intermediate transfer belt 173 by the primary transfer modules 171A to 171D. Then, a toner image of a color, in which layers of the yellow color, the magenta color, the cyan color, and the black color have been superimposed, is formed and is transferred to the conveyed paper P by the secondary transfer unit 172.

The intermediate transfer belt 173 serves as an image carrying member and is configured to be able to carry the toner image transferred by the primary transfer unit 171. The intermediate transfer belt 173 is an endless belt, is wound by a plurality of rollers, and is supported to be travelable. The paper P is conveyed to the intermediate transfer belt 173 by the paper conveying unit 160.

The intermediate transfer belt 173 travels by rotating in a direction (a clockwise direction on the plane) indicated by an arrow R of FIG. 1 under the control of the control unit 200. In addition, in the following description, a direction in which the intermediate transfer belt 173 rotates when an image formation is performed in the image forming apparatus 100 will be referred to as a "rotation direction" of the intermediate transfer belt 173.

Furthermore, the intermediate transfer cleaning unit 174 removes toner remaining on the intermediate transfer belt 173.

<Fixing Unit>

The fixing unit 180 fixes the toner image transferred to the paper P. The fixing unit 180 includes a heating roller 181, a pressing roller 182, and a paper separation unit 183.

The heating roller 181 conveys and heats the paper P with the transferred toner image. The pressing roller 182 conveys and presses the paper P with the transferred toner image. The heating roller 181 and the pressing roller 182 serve as a fixing member.

The paper separation unit 183 separates a paper from the heating roller 181. The paper separation unit 183 includes a blowing fan and a nozzle. The speed of air sent from the blowing fan increases in the interior of the nozzle, and the air is injected toward the paper P of a paper outlet of a nip portion of the fixing unit 180. As a consequence, the paper P is separated from the heating roller 181.

<Paper Discharge Unit>

The paper discharge unit 190 discharges the paper P conveyed from the fixing unit 180. In detail, the paper discharge unit 190 winds the paper P conveyed from the fixing unit 180 around a support axis at a constant speed by a plurality of rollers. In addition, the paper P of the paper discharge unit 190 is not always needed to be held in a roll shape, and may be cut in each page.

<Control Unit>

The control unit 200 is connected to the image reading unit 110, the operation display unit 120, the image forming unit 130, the first paper feeding unit 140, the second paper feeding unit 150, the paper conveying unit 160, the transfer unit 170, the fixing unit 180, and the paper discharge unit 190, and controls each of these elements.

The control unit 200 includes a CPU (Central Processing Unit), a HDD (Hard Disk Drive), a RAM (Random Access Memory), and a ROM (Read Only Memory) (not shown).

The CPU executes a control program to control the aforementioned each element. The HDD is a storage device with large capacity, and preserves various programs such as the control program and application software, various types of setting information, etc. In the present embodiment, paper width information and toner use history are also preserved in the HDD. The RAM temporarily stores the control program and an operation result. Furthermore, the ROM stores parameters required when the CPU executes the control program, and various pieces of data. An image forming method of the present embodiment, which will be described below, is realized when the CPU executes the control program and thus the aforementioned each element is controlled.

The control unit 200 controls the image forming unit 130 and the transfer unit 170, thereby forming the toner layer on the surface of the intermediate transfer belt 173. The control unit 200 serves as a toner layer forming unit.

<Image Forming Method>

Figure 2:
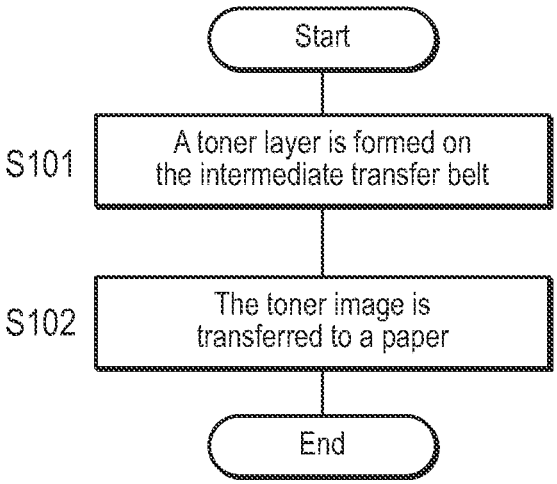
FIG. 2 is a flowchart for explaining an image forming method in a first embodiment of the present invention.
Figure 3A:
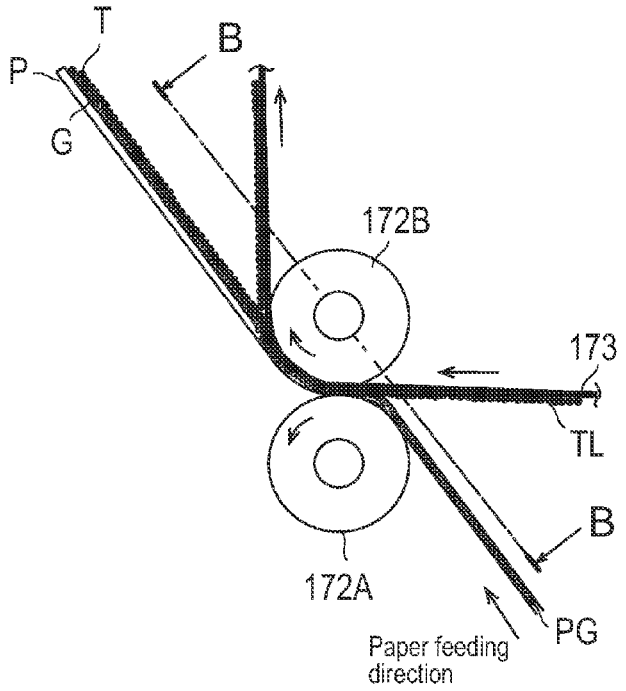
FIG. 3A is a sectional view for explaining the formation of a toner layer in a first embodiment of the present invention.
Figure 3B:
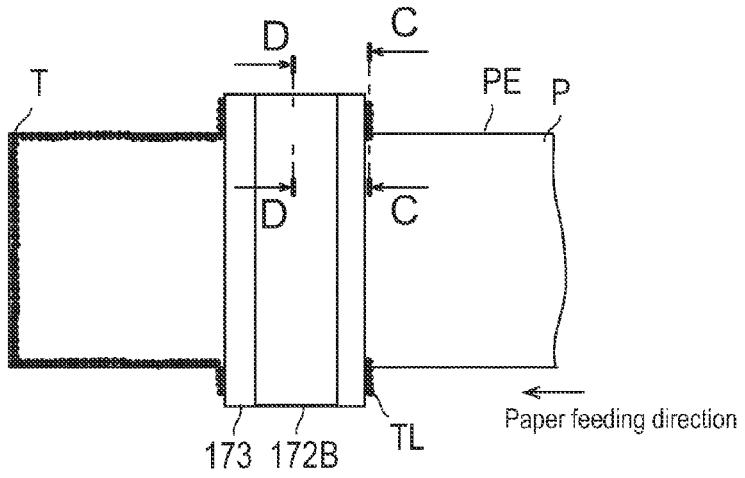
FIG. 3B is a sectional view taken along line B-B of FIG. 3A.
Figure 3C:
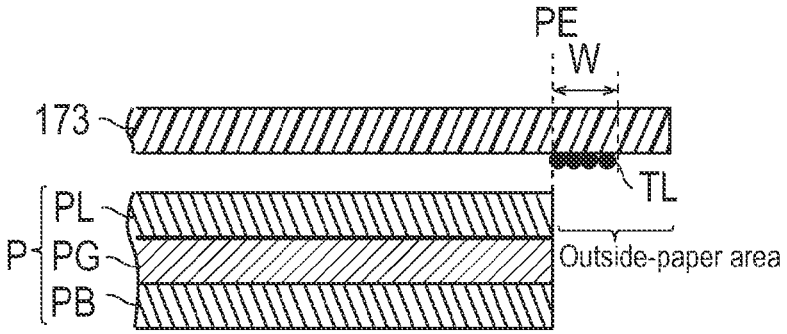
FIG. 3C is a sectional view taken along line C-C of FIG. 3B.
Figure 3D:
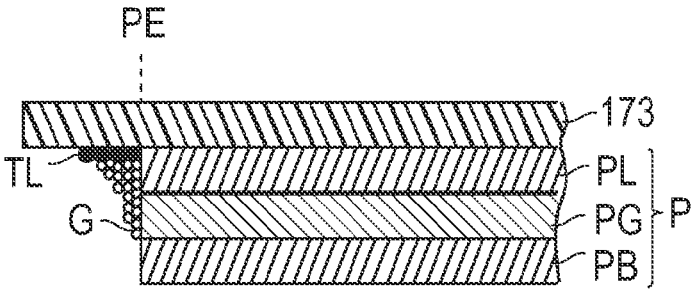
FIG. 3D is a sectional view taken along line D-D of FIG. 3B.
Figure 4:
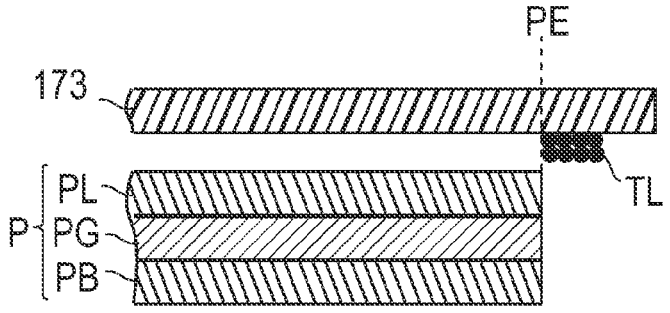
FIG. 4 is a diagram showing the casein which a toner layer stacked on the surface of an intermediate transfer belt is formed in a first embodiment of the present invention.

Next, with reference to FIG. 2 to FIG. 4, an image forming method of the first embodiment of the present invention will be described. FIG. 2 is a flowchart for explaining the image forming method in the first embodiment of the present invention. Furthermore, FIG. 3A is a sectional view for explaining the formation of a toner layer in the first embodiment of the present invention, FIG. 3B is a sectional view taken along line B-B of FIG. 3A, FIG. 3C is a sectional view taken along line C-C of FIG. 3B, and FIG. 3D is a sectional view taken along line D-D of FIG. 3B. Furthermore, FIG. 4 is a diagram showing the case in which a toner layer stacked on the surface of the intermediate transfer belt is formed in the first embodiment of the present invention.

As shown in FIG. 2, firstly, a toner layer is formed on the intermediate transfer belt (step S101). The control unit 200 controls the image forming unit 130 such that a toner layer having a predetermined width is formed at an outer side of the paper P from a position corresponding to the end portion of the paper P on the surface of the intermediate transfer belt 173. In more detail, based on the size of the fed paper P and a paper feeding timing, the control unit 200 calculates the position corresponding to the end portion of the paper P on the surface of the intermediate transfer belt 173. In addition, the end portion of the paper P includes a front end portion, both side end portions, and a rear end portion.

The optical writing unit 133 forms an electrostatic latent image corresponding to image data, and forms an electrostatic latent image corresponding to the toner layer on the photosensitive drum 131 based on the calculated position corresponding to the end portion.

Then, the developing device 134 develops the electrostatic latent image formed on the photosensitive drum 131, thereby forming a toner image and the toner layer corresponding to the image data and the toner layer. Moreover, the toner image and the toner layer formed on the photosensitive drum 131 are transferred to the intermediate transfer belt 173 by the primary transfer unit 171.

Next, the toner image is transferred to a paper (step S102). As shown in FIG. 3A and FIG. 3B, the paper P is conveyed in press-contact with the intermediate transfer belt 173 with the formed toner image along a paper feeding direction indicated by an arrow, so that the toner image is transferred to the paper P. At this time, it is probable that an adhesive projects from the paper P. However, in the present embodiment, since the toner layer has been formed on the surface of the intermediate transfer belt 173, the adhesive projecting from the end portion of the paper P is attached to the toner layer of the intermediate transfer belt 173, and is transferred to the paper P as is together with the toner layer. Consequently, the adhesive projecting from the paper P is not attached to the surface of the intermediate transfer belt 173.

On the other hand, a toner layer TL not transferred to the paper P remains attached to the intermediate transfer belt 173, is delivered at a downstream side in the rotation direction of the intermediate transfer belt 173, and is removed by the intermediate transfer cleaning unit 174.

Hereinafter, with reference to FIG. 3C and FIG. 3D, the principle in which in the transfer unit 170 of the present embodiment, the adhesive projecting from the paper P is prevented from being attached to the member of the transfer unit 170 will be described in detail.

As shown in FIG. 3C, in the present embodiment, on a surface of an outside-paper area of the intermediate transfer belt 173, a toner layer TL having a predetermined width w is formed in one layer at an outer side of the paper P from a position corresponding to the end portion PE of the paper P. Preferably, the predetermined width w, for example, is about 2 mm to about 3 mm. This is because when the toner layer TL is formed with a width of about 2 mm, even though an adhesive projects from the end portion PE of the paper P, it is possible to reliably prevent the adhesive from being attached to the surface of the intermediate transfer belt 173.

In addition, in an image area of the surface of the intermediate transfer belt 173, the toner image has been formed, but is not shown. Furthermore, the paper P of the present embodiment is a label paper, and includes a pasteboard PB, an adhesive layer PG formed on the pasteboard PB, and a release paper PL formed on the adhesive layer PG.

As shown in FIG. 3D, when the toner image of the intermediate transfer belt 173 is transferred to the paper P, constant pressure is applied to the paper P by the secondary transfer roller 172A and the secondary transfer opposing roller 172B. As a consequence, it is probable that an adhesive G projects from the end portion PE of the paper P and moves to the intermediate transfer belt 173 through the paper end portion PE.

However, in the present embodiment, since the toner layer TL is formed at the outer side of the paper P from the position corresponding to the end portion PE of the paper P on the surface of the intermediate transfer belt 173, the adhesive G projecting from the end portion PE of the paper P is attached to the toner layer TL and is transferred onto the paper P. Consequently, it is possible to reliably prevent the adhesive G projecting from the end portion PE of the paper P from being attached to the surface of the intermediate transfer belt 173. As a consequence, it is possible to prevent image failure due to the attachment of the adhesive G to the intermediate transfer belt 173. Furthermore, it is not necessary to clean or exchange a member due to the attachment of the adhesive G.

In addition, toner used to form the toner layer TL may have any color of YMCK, but it is preferable that toner of a color with a small consumption amount (i.e. a low print coverage) is preferentially used in the formation of the toner layer TL. The toner of the color with the low print coverage is preferentially used in the formation of the toner layer TL, so that discharge of deteriorated toner is promoted and thus it is possible to uniformly maintain the quality of toner held by the developing device 134 of a print coverage.

Furthermore, in the present embodiment, as described above, toner T may be attached to the end portion of the paper P with the transferred toner image. When the toner T is attached to the end portion of the paper P, the end portion of the paper P is colored with a color of the toner T. However, in the label paper, a release line for releasing a release paper is formed in the inner side of the end portion of the release paper in many cases, an inner portion of the release paper is used as a seal, and an outer portion of the release paper is typically discarded. Consequently, even though the end portion of the paper P with the transferred toner image is colored with the color of the toner T, since the outer portion of the release paper is discarded, there is no problem in many cases. When the end portion of the release paper is colored and a problem occurs, colorless toner may be provided to the image forming unit 130 in addition to the toner of YMCK, and the toner layer TL may be formed with the colorless toner.

Furthermore, in the example shown in FIG. 3C, the case in which one layer (a single layer) of the toner layer TL is formed at the outer side of the paper P from the position corresponding to the end portion of the paper P has been described. However, as shown in FIG. 4, a plurality of stacked toner layers may be formed. In this way, when the stacked toner layers TL are formed, since the number of toner particles adhering to the adhesive G increases, it is possible to more reliably prevent the transfer of the adhesive to the intermediate transfer belt 173.

EXAMPLE

An image has been printed on a label paper by using the image forming apparatus 100 of the present embodiment. Table 1 below shows an evaluation result of a transfer amount of an adhesive and a printed image when an image has been printed on the label paper by using the image forming apparatus 100. Furthermore, Table 1 below also shows an evaluation result when an image has been printed on the label paper without using the image forming apparatus 100 of the present embodiment.

In Table 1 below, an "adhesive transfer amount" indicates a transfer amount of an adhesive when a label paper having an A3 size passed through. Furthermore, "image failure (white streaks)" indicates image failure of white streaks of a paper conveyance direction when a halftone image of an SRA 3 size (320×450 mm) has been sampled. The SRA 3 size indicates a size slightly larger than the A3 size (297×420 mm). Consequently, in the case in which an adhesive is transferred when the label paper having the A3 size has been fed, it is estimated that the image failure of white streaks occurs if an image is printed using a paper of the SRA 3 size afterward, so that it is possible to confirm image failure due to the transfer of the adhesive.

In the present example, a paper is continuously fed to 2 km, and an adhesive transfer amount and image failure (white streaks) have been evaluated in each 0.5 km.

TABLE 1

| Paper feeding | Adhesive transfer amount | | Image failure (white streaks) | |
|---|---|---|---|---|
| distance (km) | Comparative example | Example | Comparative example | Example |
| 0 | ○ | ○ | ○ | ○ |
| 0.5 | Δ | ○ | Δ | ○ |
| 1 | x | ○ | x | ○ |
| 1.5 | xx | ○ | xx | ○ |
| 2 | xx | ○ | xx | ○ |

In Table 1 above, "○" indicates "no transfer" or "no white streaks", and "Δ" indicates "presence of slight transfer" or "presence of slight white streaks". Furthermore, "x" indicates "presence of transfer" or "presence of white streaks", and "xx" indicates "presence of severe transfer" or "presence of severe white streaks".

As described above, in the comparative example, as the paper feeding distance becomes long, the amount of an adhesive transferred to an intermediate transfer belt has increased and thus the image failure of white streaks has also increased. On the other hand, in the present example, no adhesive is transferred to an intermediate transfer belt, so that it is possible to acquire a clean image with no white streaks.

(Second Embodiment)

In the first embodiment, the case in which the toner layer is formed at the outer side of the paper from the position corresponding to the end portion of the paper on the surface of the intermediate transfer belt has been described.

Figure 5:
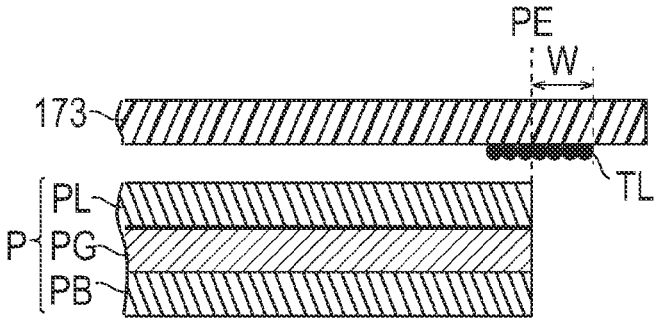
FIG. 5 is a sectional view for explaining the formation of a toner layer in a second embodiment of the present invention.

FIG. 5 is a sectional view for explaining the formation of a toner layer in a second embodiment of the present invention. Hereinafter, in order to avoid redundancy of a description, a description of the same configuration as that of the first embodiment will be omitted.

As shown in FIG. 5, in the second embodiment, the toner layer TL is formed from the inner side to the outer side across the position corresponding to the end portion PE of the paper P on the surface of the intermediate transfer belt 173. Preferably, the toner layer formed in the inner side of the end portion PE is formed at an outer side of an area of the toner image so as not to overlap the area of the toner image, and a width of the toner layer is narrower than a width w of the toner layer formed at the outer side.

In this way, the toner layer TL is formed, so that it is possible to more reliably suppress the transfer of the adhesive to the intermediate transfer belt 173. In detail, even though the amount of the adhesive G projecting from the paper P is large and the adhesive G projects into the inner side of the end portion PE of the paper P, it is possible to prevent the adhesive G from being attached to the intermediate transfer belt 173. Furthermore, even when a shift has occurred in the position of the end portion PE of the paper Pin the secondary transfer unit 172, it is possible to prevent the adhesive projecting from the paper P from being attached to the intermediate transfer belt 173.

In addition, in the example shown in FIG. 5, the case in which the toner layer is formed in one layer from the inner side to the outer side across the position corresponding to the end portion PE of the paper P has been described. However, a plurality of stacked toner layers may be formed.

(Third Embodiment)

Figure 6:
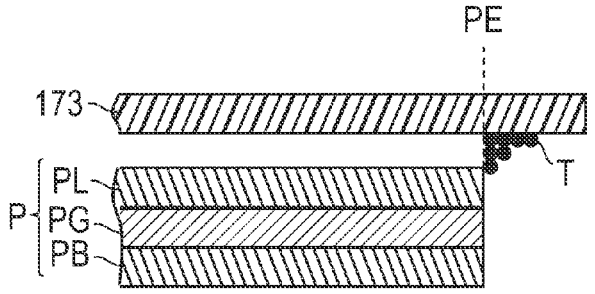
FIG. 6 is a sectional view for explaining the formation of a toner layer in a third embodiment of the present invention.

FIG. 6 is a sectional view for explaining the formation of a toner layer in a third embodiment of the present invention. In order to avoid redundancy of a description, a description of the same configuration as that of the first embodiment will be omitted.

As shown in FIG. 6, in the third embodiment, the toner layer TL is formed such that the number of stacked toner increases as it goes toward the position corresponding to the end portion PE of the paper P on the surface of the intermediate transfer belt 173. In addition, the number of stacked toner can be adjusted by changing the degree, in which the optical writing unit 133 exposes the photosensitive drum 131 in response to the position of the surface of the photosensitive drum 131, so as to change the amplitude of potential.

In this way, the toner layer TL is formed, so that the number of toner particles in the vicinity of the end portion PE, from which a large amount of adhesive G projects, increases, and thus it is possible to more reliably prevent the transfer of the adhesive to the intermediate transfer belt 173.

(Fourth Embodiment)

Figure 7:
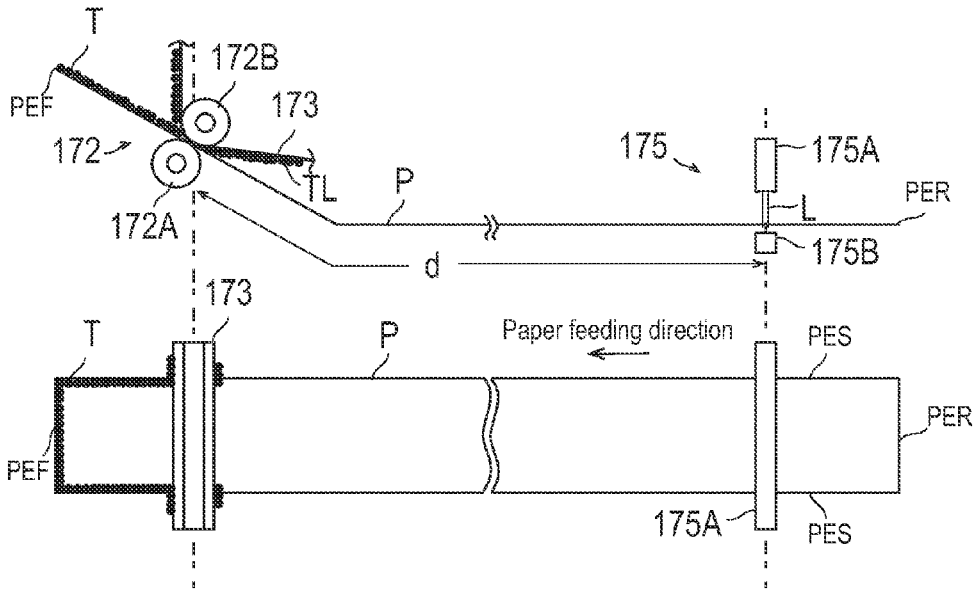
FIG. 7 is a schematic diagram showing the structure of an image forming apparatus in a fourth embodiment of the present invention.
Figure 8:
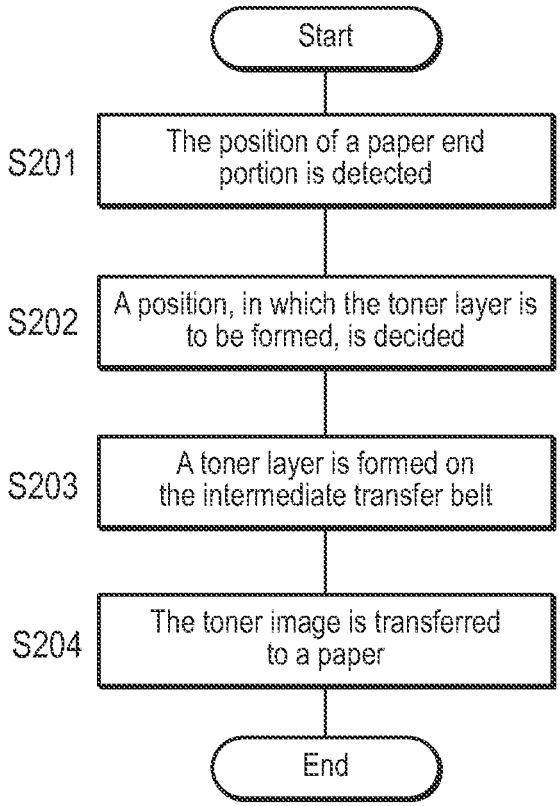
FIG. 8 is a flowchart for explaining an image forming method in a fourth embodiment of the present invention.

FIG. 7 is a schematic diagram showing the structure of an image forming apparatus in a fourth embodiment of the present invention, and FIG. 8 is a flowchart for explaining an image forming method in the fourth embodiment of the present invention.

In the fourth embodiment, the case in which the end portion of a paper in the surface of the intermediate transfer belt is detected and a toner layer formation position is decided in response to a detection result of the paper end position will be described. In order to avoid redundancy of a description, a description of the same configuration as that of the first embodiment will be omitted.

<Paper End Detection Unit>

As shown in FIG. 7, the image forming apparatus 100 includes a detection unit 175. The detection unit 175 includes a light emitting unit 175A and a light receiving unit 175B, and is installed at a position of a distance d along a conveyance path of the paper P from the nip portion of the secondary transfer unit 172.

The light emitting unit 175A irradiates laser light L toward the light receiving unit 175B according to an instruction of the control unit 200. The light emitting unit 175A has a light emitting surface with a length in the width direction of the paper P longer than the width of the paper P, and is arranged in a position spaced apart from the conveyance path by a predetermined distance at one surface side of the paper P conveyed through the conveyance path.

The light receiving unit 175B receives the laser light L from the light emitting unit 175A, and transmits a light receiving signal to the control unit 200. The light receiving unit 175B has a light receiving surface having a size corresponding to the light emitting surface of the light emitting unit 175A and an image sensor. The image sensor includes a plurality of light receiving elements arranged in at least one row in the width direction of the paper P, and detects light passing through the light receiving surface. The light receiving unit 175B is arranged in a position of the other surface side the paper P conveyed through the conveyance path, the position facing the light emitting unit 175A.

The control unit 200 interprets the light receiving signal from the light receiving unit 175B when the paper P passes through the detection unit 175, and detects the positions of a front end portion PEF, a side end portion PES, and a rear end portion PER of the paper P in the surface of the intermediate transfer belt 173. In the present embodiment, the detection unit 175 and the control unit 200 serve as a paper end detection unit.

Hereinafter, with reference to FIG. 8, an image forming method of the image forming apparatus of the present embodiment having such a configuration will be described.

<Image Forming Method>

As shown in FIG. 8, firstly, the position of a paper end portion is detected (step S201). In more detail, the control unit 200 controls the second paper feeding unit 150 and the paper conveying unit 160 to convey the paper P toward the transfer unit 170, and controls the light emitting unit 175A to scan the laser light L toward the light receiving unit 175B in the width direction of the paper P. The light receiving unit 175B detects the laser light L by the image sensor, generates a light receiving signal corresponding to the intensity of the light, and transmits the light receiving signal to the control unit 200.

Before the paper P reaches the light receiving unit 175B, the light receiving surface of the light receiving unit 175B is not blocked, and the laser light L from the light emitting surface of the light emitting unit 175A is incident into the entire light receiving surface of the light receiving unit 175B. Consequently, the plurality of light receiving elements of the image sensor can generate light receiving signals having substantially the same magnitude. Based on the light receiving signals, the control unit 200 determines that the front end portion PEF of the paper P has not reached the detection unit 175.

On the other hand, when the paper P reaches the light receiving unit 175B and passes therethrough, the paper P partially covers the light receiving surface of the light receiving unit 175B. As a consequence, the intensity of light received in light receiving elements corresponding to a part covered by the paper P is reduced, resulting in a change in light receiving signals output by the light receiving elements. Based on the change in the light receiving signals, the control unit 200 determines that the front end portion PEF of the paper P has reached the detection unit 175, and calculates the position of the side end portion PES of the paper P on the light receiving surface of the light receiving unit 175B.

Moreover, when the paper P completely passes through the light receiving unit 175B, since the light receiving surface of the light receiving unit 175B is not blocked again, the laser light L from the light emitting unit 175A is incident into the entire light receiving surface of the light receiving unit 175B. As a consequence, the intensity of light received in corresponding light receiving elements is increased, resulting in a change in light receiving signals output by the light receiving elements. Based on the change in the light receiving signals, the control unit 200 determines that the rear end portion PER of the paper P has passed through the detection unit 175.

Next, a position, in which the toner layer is to be formed, is decided (step S202). Based on a time t1 at which the front end portion PEF of the paper P has reached the detection unit 175, a time t2 at which the rear end portion PER has passed through the detection unit, and the position of the side end portion PES, the control unit 200 calculates a position in which the toner layer TL is to be formed on the surface of the intermediate transfer belt 173.

Then, the control unit 200 controls the image forming unit 130 such that the toner layer TL having a predetermined width is formed at an outer side of the paper P from positions corresponding to the front end portion PEF, the side end portion PES, and the rear end portion PER of the paper P on the surface of the intermediate transfer belt 173.

In more detail, based on a speed at which the paper P is conveyed through the conveyance path, a distance d, and a time t1, the control unit 200 calculates a time t3 at which the paper P reaches the nip portion of the transfer unit 170. Then, the control unit 200 instructs the image forming unit 130 to form a toner layer such that the toner layer TL corresponding to the front end portion PEF of the paper P is formed on the surface of the intermediate transfer belt 173 passing through the nip portion at the time t3. That is, the control unit 200 moves the surface of the intermediate transfer belt 173 with the formed toner layer TL to the nip portion of the secondary transfer unit 172 in synchronization with the time t3 at which the conveyed paper P reaches the nip portion of the secondary transfer unit 172.

In addition, in order to reflect the detection result of the end portion of the paper P in the toner layer formation, the distance d from the detection unit 175 to the nip portion is needed to be set to be longer than a distance from an image writing position to the photosensitive drum 131 to the nip portion of the secondary transfer unit 172. The distance d is at least longer than the distance from the image writing position to the photosensitive drum 131 corresponding to a black color to the nip portion of the secondary transfer unit 172, and is preferably longer than a distance from the image writing position to the photosensitive drum 131 corresponding to a yellow color to the nip portion.

Furthermore, based on the position of the side end portion PES of the paper P, the control unit 200 calculates a deviation amount of the paper P in the conveyance path, and decides a position, in which the toner layer TL is to be formed, on the surface of the intermediate transfer belt 173 in consideration of the deviation amount of the paper P.

Moreover, based on the time t2 at which the rear end portion PER has passed through the detection unit, the control unit 200 instructs the image forming unit 130 to form a toner layer such that the toner layer TL corresponding to the rear end portion PER of the paper P is formed on the surface of the intermediate transfer belt 173.

Next, a toner layer is formed on the intermediate transfer belt (step S203). The image forming unit 130 forms a toner image and the toner layer TL on the photosensitive drum 131, and the primary transfer unit 171 forms the toner image and the toner layer TL on the intermediate transfer belt 173.

Next, the toner image is transferred to a paper (step S204). The paper P is conveyed in press-contact with the intermediate transfer belt 173 with the formed toner image along a paper feeding direction indicated by an arrow, so that the toner image is transferred to the paper P.

As described above, in the present embodiment, the position of the side end portion PES of the paper P is detected by the paper end detection unit, and a position, in which the toner image TL is to be formed on the surface of the intermediate transfer belt 173, is decided in response to the detection result of the paper end detection unit. Consequently, even though the paper P meanders on the conveyance path, it is possible to exactly acquire the position of the paper side end portion PES. As a consequence, it is possible to reliably prevent the adhesive G projecting from the side end portion PES of the paper P from being attached to the surface of the intermediate transfer belt 173.

In addition, in the present embodiment, the case in which the end portions PEF, PES, and PER of the paper P are optically detected using the laser light has been described. However, for example, the front end portion PEF, the side end portion PES, and the rear end portion PER of the paper P may be detected using a contact type sensor.

As described above, in the embodiments, the image forming apparatus and the image forming method of the present invention have been described. However, it goes without saying that addition, modification, and omission can be appropriately made by those skilled in the art within the technical scope of the present invention.

For example, in the aforementioned first to fourth embodiments, the image forming apparatus employing the intermediate transfer scheme has been described. However, the present invention shall not be limited to the image forming apparatus of the intermediate transfer scheme, and the present invention can be applied to an image forming apparatus employing a direct transfer scheme. In the case of employing the direct transfer scheme, the control unit controls the paper conveying unit and the toner layer forming unit to convey a paper to the photosensitive drum capable of carrying an image and to form a toner layer having a predetermined width at an outer side of the paper from a position corresponding to the end portion of the paper on the surface of the photosensitive drum. Then, the control unit controls the transfer unit to transfer the image to the paper by conveying the paper in press-contact with the photosensitive drum with the formed image and toner layer.

Furthermore, in the aforementioned first to fourth embodiments, the case in which the foreign matter is an adhesive has been described. However, even though the foreign matter is cutting waste of a paper, rubbish, etc., it is possible to prevent the foreign matter from being attached to the member of the transfer unit by the configuration of the present invention.

What is claimed is:

1. An image forming apparatus comprising:

an image carrying member capable of carrying an image;

a paper conveying unit for conveying a paper to said image carrying member;

a toner layer forming unit for forming a toner layer having a predetermined width at an outer side of said paper from a position corresponding to an end portion of said paper on a surface of said image carrying member; and a transfer unit for conveying said paper in press-contact with said image carrying member with said formed image and toner layer and transferring said image to said paper;

wherein said toner layer forming unit forms a larger number of stacked toner as it goes toward said position corresponding to said end portion of said paper in said surface of said image carrying member.

2. The image forming apparatus as claimed in claim 1, wherein said toner layer forming unit forms a toner layer from an inner side to an outer side across a position corresponding to said end portion of said paper on said surface of said image carrying member.

3. The image forming apparatus as claimed in claim 1, wherein said toner layer forming unit forms a single layer of toner layer or a plurality of stacked toner layers.

4. The image forming apparatus as claimed in claim 1, wherein said toner layer forming unit forms said toner layer by using toner of a color with a small consumption amount.

5. The image forming apparatus as claimed in claim 1, further comprising:

a paper end detection unit for detecting said end portion of said paper, wherein said toner layer forming unit decides a position, in which said toner layer is to be formed, in response to a detection result of said paper end detection unit.

6. The image forming apparatus as claimed in claim 1, wherein said image carrying member includes an intermediate transfer belt.

7. The image forming apparatus as claimed in claim 1, wherein said image carrying member includes a photosensitive drum.

8. The image forming apparatus as claimed in claim 1, wherein said paper includes an adhesive layer.

9. An image forming method comprising:

conveying a paper to an image carrying member capable of carrying an image, and forming a toner layer having a predetermined width at an outer side of said paper from a position corresponding to an end portion of said paper on a surface of said image carrying member; and conveying said paper in press-contact with said image carrying member with said formed image and toner layer and transferring said image to said paper;

wherein said step of forming said toner layer comprises:

forming a larger number of stacked toner as it goes toward said position corresponding to said end portion of said paper in said surface of said image carrying member.

10. The image forming method as claimed in claim 9, wherein said step of forming said toner layer further comprises a step of:

forming a toner layer from an inner side to an outer side across a position corresponding to said end portion of said paper on said surface of said image carrying member.

11. The image forming method as claimed in claim 9, wherein said step of forming said toner layer comprises:

forming a single layer of toner layer or a plurality of stacked toner layers.

12. The image forming method as claimed in claim 9, wherein said step of forming said toner layer comprises:

forming said toner layer using toner of a color with a small consumption amount.

13. The image forming method as claimed in claim 9, further comprising a step of:

detecting said end portion of said paper, wherein said step of forming said toner layer comprises:

deciding a position, in which said toner layer is to be formed, in response to a detection result of said step of detecting said end portion of said paper.

14. The image forming method as claimed in claim 9, wherein said image carrying member includes an intermediate transfer belt.

15. The image forming method as claimed in claim 9, wherein said image carrying member includes a photosensitive drum.

16. The image forming method as claimed in claim 9, wherein said paper includes an adhesive layer.

* * * * *